United States Patent [19]

Brears

[11] 4,084,356

[45] Apr. 18, 1978

[54] METHOD OF FINISHING A RANDOM CONTOURED SURFACE

[75] Inventor: John H. Brears, North Vancouver, Canada

[73] Assignee: MacMillan Bloedel Limited, Vancouver, Canada

[21] Appl. No.: 691,306

[22] Filed: Jun. 1, 1976

[51] Int. Cl.[2] ..... B24B 1/00; B24B 21/08

[52] U.S. Cl. ..... 51/328; 51/141; 144/309 R

[58] Field of Search ..... 51/137–139, 51/141, 328; 144/309 R, 320

[56] References Cited

U.S. PATENT DOCUMENTS

| | | | |
|---|---|---|---|
| 3,167,889 | 2/1965 | Jacobi | 51/141 |
| 3,283,447 | 11/1966 | Cretsinger | 51/141 |
| 3,364,626 | 1/1968 | Keyes | 51/138 |
| 3,408,775 | 11/1968 | Rutt | 51/141 X |
| 3,541,736 | 12/1970 | Takekawa | 51/141 |
| 3,611,647 | 10/1971 | Davis | 51/328 |
| 4,031,668 | 6/1977 | Lasko | 51/141 |

*Primary Examiner*—Harold D. Whitehead
*Assistant Examiner*—Nicholas P. Godici
*Attorney, Agent, or Firm*—Larson, Taylor & Hinds

[57] ABSTRACT

A method and a device for accomplishing the method are disclosed for finishing a random contoured surface of a panelboard. The device includes means for advancing the panelboard in contact with a sanding belt, a flexible membrane located adjacent to a portion of the sanding belt extending for at least the width of the panelboard, and pressure means providing an even pressure on the flexible membrane to force the sanding belt to conform to the random contoured surface of the panelboard. The device removes the slippery case hardened surface from a waferboard which can result in boards slipping when stacked on the sloped surface of a roof. Furthermore, the method applies low pressure to the surface of a board which removes only a small amount of material and leaves a roughened surface.

8 Claims, 3 Drawing Figures

METHOD OF FINISHING A RANDOM CONTOURED SURFACE

This invention relates to a modified surface finish on a panelboard or the like. More specifically, this invention relates to a device and a method for sanding a random contoured surface with a minimum reduction of material thickness. The resulting surface is non-slippery.

Panelboard includes plywood flakeboard, waferboard and particleboard. Waferboard, for instance, is made by compressing a random or oriented arrangement of wood wafers, with a predeterimined quantity of resin under controlled conditions of pressure and temperature. The resulting waferboard has a slippery surface. Furthermore, the surface is not usually flat but tends to be randomly contoured due to the uneven arrangement of wafers within the board. The slippery surface of the waferboard is a disadvantage when waferboards are stacked one upon another, and particularly when the stacks are at an angle, such as when they are used in the construction of a roof. The slippery surface allows the waferboards to slide and this may be dangerous if the stacks of the waferboards are on a roof.

By using a coarse sanding blet, the slippery waferboard surface can be roughened to avoid boards sliding. Many existing sanding devices use a fixed drum or bar or in some cases a bar with limited floating action to press the sanding belts against the surface of the board. Thus, sanding occurs across a flat plane, and in order to sand the whole of the random contoured surface of a board, despite thickness variation away from this plane, the thickness or depth of sanding cut may be as much as .050 inch. A thinner cut may leave unsanded patches where the surface has not been touched by the sanding belt. When a cut of this depth is removed from a board, overall structural strength is reduced. Since many product specifications require strength abd thickness to be maintained at certain standards, a thicker board must therefore be produced initially to allow for the necessary depth of sanding cut.

Some panelboards used in cabinets for television sets, stereos and other pieces of furniture have a thin outer surface veneer of a hard such as walnut. In many cases this veneer has taped applied to the surface during the forming steps. Attempts to remove this tape on conventional sanding devices can cause problems because in some cases the depth of sanding is such that the surface veneer is reduced to paper thickness or even removed completely.

Contour sanding machines employed today have utilized the basic principle of a rigid bar for forcing a sanding belt onto a board surface. In some cases the bar has a limited floating action and consists of several individual pressurized sections across the width of the machine. Each section is, however, in itself still rigid and is, for example, 6 inches long and 4 inches wide. Because of the design of these sanding machines, particularly with respect to the belt tensioning system and the existence of high tension where the belt moves over the bar, considerable force is employed to pressurize each separate section of the bar. In another type of contour sanding machine, a number of narrow sanding belts are staggered across the width of the machine. However, as in the previous case each sanding belt is rigid across its width. The result is that the so-called contour sanding still removes, for example, 0.010 inch per side.

It is one object of the present invention to provide a method for removing the slippery surface from a panelboard with a minimum reduction of its thickness.

A further object of the present invention is to provide a method for sanding a random contoured surface and remove surface blemishes or tape adhering to the surface with a minimum reduction of material thickness.

It is another object of the invention to provide a method and a device for sanding a random contoured surface of a panelboard to roughen the entire surface comparatively evenly without undue loss of material.

I have found that these disadvantages may be overcome and the objects of the present invention may be achieved by a contour sander having a flexible deformable membrane pressing a sanding belt against the surface of a board. The flexible membrane is pressed onto an area of the sanding belt by a pressure maintained substantially constant over the area, thus forcing the sanding belt to conform to the random contoured surface of the board. The pressure may be varied, but I have found that, by using a comparatively large area, only a low pressure is required, and this removes a layer of approximately 0.002 to 0.005 inch evenly across the entire surface. The thickness of this removed layer is related to the size of the area of the sanding belt pressing onto the board, the pressure on this area, and the relative speed between the sanding belt and the board surface. Furthermore, I have found that the finished panelboard has a non-slippery or frictional surface. When a waferboard is processed on a contour sander of the present invention, the slippery surface is removed and the surface appearance retains the full shape of the individual wafers.

The present invention provides a method of finishing a random contoured surface of a panelboard comprising the steps of advancing a panelboard in contact with a sanding surface of a sanding belt, pressing a flexible membrane with an even pressure onto a portion of the sanding belt to force the sanding surface to follow the random contoured surface of the panelboard. In a preferred embodiment, the flexible membrane is as wide as the panelboard and has a length in the range of 6 to 24 inches pressing on the sanding belt, the pressure on the flexible membrane is in the range of approximately 0.25 to 10 lbs. per square inch and a relative speed between the sanding belt and the panelboard is up to approximately 2,000 feet per minute. In another embodiment, the sanding surface of the belt removes a thickness of approximately 0.002 to 0.005 inch evenly from the random contoured surface of the panelboard. In a further embodiment the flexible membrane is pressed against the sanding belt at a pressure within the range of 0.5 to 4 lbs. per square inch.

The invention also provides a device for finishing a random contoured surface of a panelboard comprising a sanding belt, means for advancing the board in contact with the sanding belt, a flexible membrane located adjacent a portion of the sanding belt extending for at least the width of the panelboard, pressure means adapted to provide an even pressure on the flexible membrane to force the sanding belt to conform to the random contoured surface of the panelboard.

Other embodiments include an even pressure on the flexible membrane in the range of approximately 0.25 to 10 lbs. per square inch, a gas acting on the flexible membrane, and means to vary the pressure in the gas. In another embodiment the flexible membrane is in the form of a flexible air bag which extends for at least the width of the board.

In the drawings which illustrate embodiments of the invention:

Figure 1:
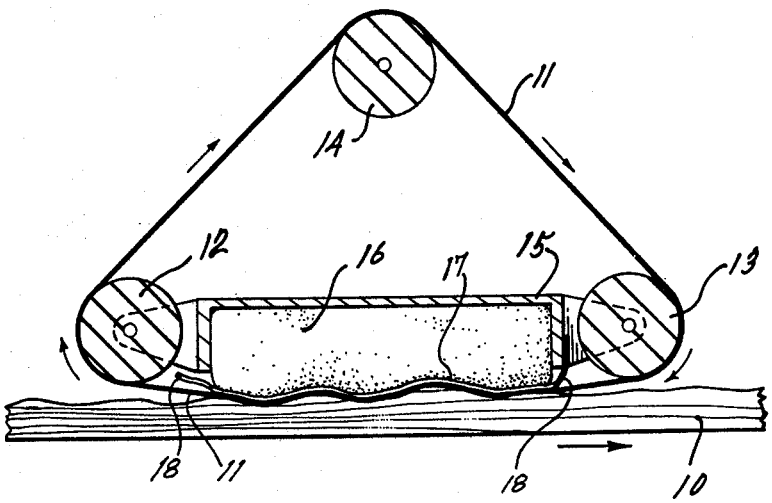
FIG. 1 is a schematic elevation showing one embodiment of a contour sander of the present invention.

Referring now to the drawings, FIG. 1 shows a panelboard 10 passing beneath a contour sander of the present invention. An endless sanding belt 11 passes between two lower belt travel rollers 12 and 13 and over an upper roller 14. A frame 15 between the two lower rollers 12 and 13 supports and air bag 16 which has a flexible membrane 17 pressing against the top inner surface of the sanding belt 11 so that the sanding belt 11 is pushed down onto the panelboard 10 and conforms to the contoured and variable surface of the panelboard as it passes beneath the sanding belt 11. The lower rollers 12 and 13 are positioned so that the belt 11 under the rollers does not contact the surface of the panelboard. Contact only occurs between the belt 11 and the surface of the panelboard directly under the flexible membrane 17. A stationary flexible anti-friction shield 18 is positioned between the flexible membrane 17 of the air bag 16 and the sanding belt 11. This shield 18 is preferably a graphite strip and is flexible to permit the movement of the belt 11 passing under the flexible membrane 17 without friction causing heating or abrasion that might damage the membrane 17 or the belt 11.

The air bag 16 extends for the full width of the sanding belt 11, and the air pressure against the flexible membrane 17 ensures full contact between the sanding surface of the sanding belt 11 and the surface of the panelboard 10. Tensioning devices (not shown) are connected to each end of the upper roller 14 and ensure there is correct tension in the belt 11 in order to keep it tracking and travelling, and at the same time allow the belt 11 To be pressured by the flexible membrane 17 so the sanding surface of the belt 11 conforms to the surface of the panelboard 10. This membrane 17 takes into account contour variations in the surfaces of the panelboard in its length and breadth. The panelboard 10 moves in the direction shown by the arrow in FIG. 1 and the belt 11 moves in the opposite direction to ensure a maximum surface speed differential between the panelboard 10 and the sanding belt 11. The depth of sanding on the panelboard 10 may be varied depending upon the length of contact of the air bag 16 on the sanding belt 11, and hence the sanding belt 11 on the surface of the panelboard 10, the air pressure within the air bag 16, the belt coarseness, belt tension, and the differential speed between the sanding belt 11 and the panelboard 10.

When a panelboard is sanded on a contour sander of the type shown in FIG. 1, the finished surface is non-slippery as compared to the panelboard's original surface.

Figure 2:
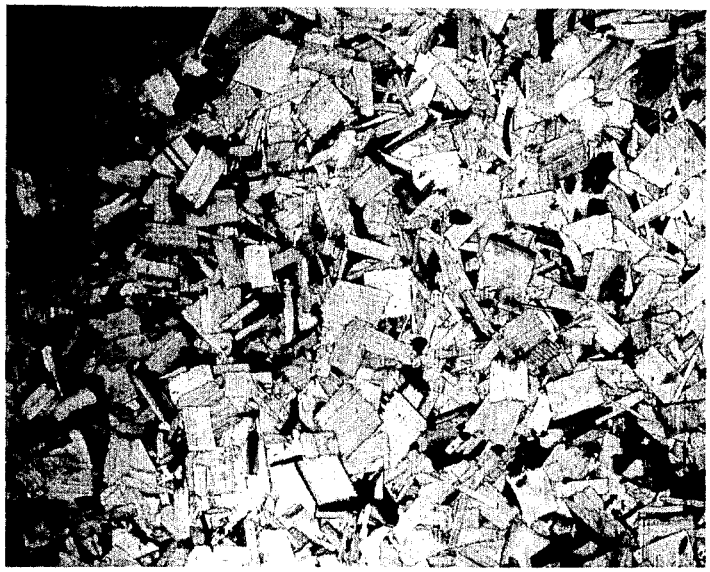
FIG. 2 is a photographic reproduction of a finished surface of a waterboard according to one embodiment of the present invention showing the retention of the full particle shape of the wafers.
Figure 3:
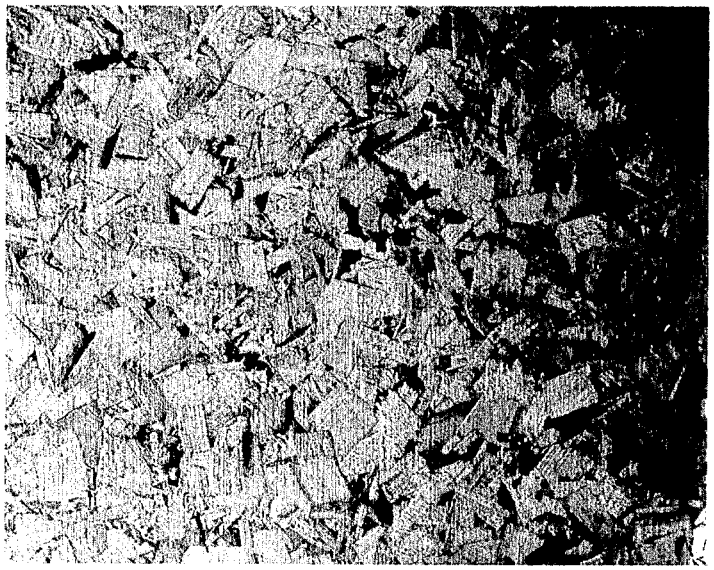
FIG. 3 is a photographic reproduction of a finished surface of a waferboard taken with oblique light to illustrate the non-slippery surface.

The finished surface of a waferboard seen in FIG. 2 highlights the full particle shape of the individual wafers which indicates that little thickness of material has been removed. The same surface when seen in oblique light, FIG. 3, shows the slippery surface removed.

In the case of waferboard a coarse range of sandpaper is preferred with a range of 80 to 24 grit size. Higher flexible membrane pressure and belt speeds are generally needed for finer grades of sandpaper. The surface of a waferboard is randomly contoured, and the sandpaper removes an even layer from this surface.

When a panelboard with a thin veneer surface is passed under a contour sander, finer grades of sandpaper are used with lower flexible membrane pressures so that little material is removed, only tape and blemishes adhering to the surface.

Pressure of the flexible membrane on the sanding belt may range from approximately 0.25 up to 10 lbs. per square inch depending on the frictional surface required and the machine operating conditions. High pressures on the belt in excess of 10 lbs. per square inch tend to remove the surface high spots and thus do not provide an even thickness removal across the random contoured surface of the panelboard. A preferred pressure range is 0.5 to 4 lbs. per square inch for processing a panelboard. In one embodiment a 1 lb. per square inch pressure acting over 24 inches of panelboard length is equivalent to a 4 lb. per square inch pressure over 6 inches of panelboard length at the same belt speed.

In another embodiment 0.5 lbs. per square inch pressure acting over 24 inches of panelboard length is equivalent to a 2 lb. per square inch pressure over 6 inches of panelboard length at the same belt speed.

Panelboards have been processed at speeds up to approximately 250 feet per minute on a contour sanding machine, and belt speeds range up to approximately 1,800 feet per minute. Preferably the belt moves in the opposite direction to the panelboard to obtain maximum relative speed between the panelboard and the belt which is up to approximately 2,000 feet per minute.

In one example, a 24 grit sanding belt was used to process panelboard. The belt was 103 inches in circumference, 51¼ inches wide, and was continuously spliced. The graphite cloth was a 450 Friction Fighter TM. The flexible membrane was a vulcanized bag made from a rubber-impregnated cotton duck. The panelboard 10 was advanced under the sanding belt 11 by means of top and bottom nip rolls which applied a pressure across the width of the panelboard entering the machine. One of the nip rolls had a rubber exterior surface to aid in gripping the panelboard; the other was a steel roll. In one test, the speed of the panelboard passing through the nip rolls was 70 feet per minute. Fixed positions idler rolls were used to support the panelboard while passing under the sanding belt and to ensure that the panelboard retained a flat position during the sanding step.

To ensure maximum time saving and production, it is preferable that each panelboard be butted to the adjacent panelboard. Thus, the sanding belt is in continuous operation and this assures that an even layer of material is removed from all the panelboard including the leading and trailing edges. In another embodiment, the upper roller was tensioned by two three-inch pneumatic cylinders, one at each end. One of the two lower rollers was driven. The two lower rollers were located in line horizontally at a centre-to-centre distance of 36 inches. Each lower roller was faced by 60 durometer neoprene rubber and was 9½ inches in diameter. The lower rollers were supported in bearings fixed rigidly to the main rectangular framework constructed from 8 inch structural steel channels. The plane of the framework was effectively the horizontal base of the triangular configuration. The driven roller for the sanding belt was powered by a 20 h.p. motor via a V-belt pulley reduction system to give a sanding belt speed of 1,200 feet per minute which could be increased up to 1,800 feet per minute.

The three rollers each had a 52 inch width to permit the use of a 51½ inch wide sanding belt. This, in turn, permitted contour sanding of edge-untrimmed or edge-trimmed panelboards up to 50 inches in width.

In the example described, an air bag was located between the two lower rollers. The bag was 24 inches long by 51½ inches wide, the same width as the sanding belt. Thus, the flexible membrane, being the side of the bag directly above the belt, pressed the portion of the sanding belt downwards over 24 inches. Full contact was, therefore, maintained between the sanding belt and the panelboard for a length of 24 inches across the width of the panelboard. The air bag was contained by a hold-down plate located within and forming part of the main framework. The depth of the air bag was approximately 4 inches when inflated. This 4 inch depth was sufficient to permit upward flexure of the sanding belt in response to contour variation in the panelboard surface with negligible change in bag air pressure. Negligible changes therefore occurred in the horsepower demand for driving either the belt or the panelboard due to contour variation. The 4 inch depth of bag permitted ¼ inch to ⅜inch thick panelboards to be sanded without variation in the height of the idler rolls.

A graphite cloth was located and fixed in between the stationary air bag and the moving sanding belt by a clamping bar attached to the main framework. The cloth covered the whole contact area between belt and bag so that no abrasion or wear occurred to the air bag. When the air bag was deflated, the tension in the sanding belt raised the sanding belt off the surface of the panelboard to the level of the lower belt rollers. Panelboards could thus be passed through the machine without being sanded merely by releasing the pressure in the air bag. An air connection to the air bag enabled the pressure to be varied at will from a compressed air supply. Furthermore, the vertical location of the sanding unit was set using spacing blocks relative to the transporting conveyor idler rolls. In this way, panelboards of different nominal thickness, such as ¼, ⅜, 7/16, ½ inch, etc., could be treated by the same machine by merely allowing the sanding belt to deflect downwards until it touches the panelboard surface. Sanding dust was removed from the machine by means of vacuum exhaust funnels located close to the contact and release points between the belt and the panelboard.

In one particular test run, the operating conditions were as follows:

Panelboard feed speed (ft./min.) — 70 to 90.
Sanding belt speed (ft./min.) — 1200 to 1800.
Sanding belt tension roll pressure (lbs./sq. in.) — 60 to 80.
Air bag pressure (lbs./sq. in.) — 0.9 to 1.2.
Air bag size — 24 inches by board width.

Starting up the machine the sanding belt drive was switched on after pressurizing the sanding belt tensioning roll and air bag and with a panelboard in position. This ensured good tracking. The panelboard feed nip rolls were then started and feeding continued with panelboards butted together.

Panelboards processed in this test run removed a thickness layer of approximately 0.002 to 0.005 inch evenly right across the surface of the panelboards. This variation in thickness removed depended on the panelboard feed speed and the pressure of the air bag forcing downwards onto the sanding belt. If the pressure was at the low side of the range and the panelboard feed speed was at the high side of the range, then the minimum thickness of material was removed from the panelboard. If the pressure was at the high side of the range and the panelboard feed speed was at the low side of the range, then the maximum thickness of material was removed.

Results of a series of tests with varying factors are shown in the following table.

TABLE

| Test Run | Air Bag Depth | Air Bag Length | Air Bag Pressure | Panel-board Speed | Belt Speed | Relative Belt/Panel-board Speed | Thickness of Layer Removed from Panel-board Surface | Belt Tension: Compressed Air Pressure | Belt Tension: Pneumatic Cylinder | Belt Grit |
|---|---|---|---|---|---|---|---|---|---|---|
| | inches | inches | lbs./sq. in. | ft./min. | ft./min. | ft./min. | inches | lbs./sq. in. | number and diameter | size |
| 1 | 1 | 24 | 0.25 | 24 | stationary | 24 | — | — | — | 36 |
| 2 | 1 | 24 | 0.33 | 24 | 100 | 124 | — | — | — | 36 |
| 3 | 1 | 24 | 0.33 | 8 | 160 | 168 | — | 60–70 | 2 × 3 in. | 24 |
| 4 | 4 | 24 | 0.9–1.0 | 70 | 1200 | 1270 | .003 | 60–70 | 2 × 3 in. | 24 |
| 5 | 4 | 24 | 1.0–1.2 | 90 | 1800 | 1900 | — | 70–80 | 2 × 3 in. | 24 |
| 6 | 2–3 | 6–8 | 3.0 | 120 | 1500 | 1620 | — | 35 | 2 × 4 in. | 24 |

In the first test, multiple passes of the panelboard were made under a stationary belt, and in the second test multiple passes of the panelboard were made under a moving belt. The remaining tests were all a single pass of a panelboard under a moving belt. The thickness of the layer removed during the test was only measured for test run member 4.

Sample panelboards made in these tests were used on a simulated roof rafter system that had a 5/12 slope. The panelboards were evaluated against unsanded spruce plywood sheets and found to have at least as high a coefficient of friction.

Although an air bag has been described in this particular embodiment, it will be clear to those skilled in the art that a flexible membrane is required adjacent to the sanding belt. The flexible membrane is joined at its sides to a box or frame, and has above it a pressure maintained substantially constant over the area of the membrane to push downwards and thus, in effect, act as an air bag. The pressure medium which has been described in the embodiment as air could be any suitable liquid, gas or combination thereof, provided the flexible membrane has the ability to force the sanding belt to follow the contour of the panelboard and provide a substantially constant pressure on the panelboard surface over the entire area of the membrane. For instance, in the case of a horizontal top sander, the membrane could form the bottom of a tank containing liquid, with the top of the tank open to atmospheric pressure. Alternatively, a system employing a series of small weights side by side or a system of pressurized rollers or levers could also be used to apply a constant pressure to the membrane.

The contour sander described in the example and shown in FIG. 1 defines a unit having a sanding head for one horizontal surface, so that to treat both sides of a panelboard, it is necessary to turn the panelboard over after the first pass and carry out a second sanding pass. Other embodiments are provided to treat both sides of a panelboard in one pass. Such a unit includes twin sanding heads which, in the case of a horizontal sander, treat the top and bottom surface of a panelboard at the same time. Another unit includes twin vertical sanding heads which allows the panelboard to be passed through in the vertical position so both sides are treated at the same time. Other changes may be made to the device which will become apparent to those skilled in the art without departing from the scope of the present invention.

I claim:

1. A method of finishing a longitudinally and transversely random contoured surface of a panelboard initially having a slippery surface with individual wood particles side by side on the surface comprising the steps of advancing a panelboard in contact with a sanding surface of a sanding belt, pressing a thin flexible membrane, deformable to follow the random contoured surface of the panelboard, with an even pressure onto a portion of the sanding belt to force the sanding surface to follow the random contoured surface of the panelboard and leaving a finished surface which is non-slippery, as compared to the panelboard's original surface.

2. The method according to claim 1 wherein the flexible membrane is as wide as the panelboard and has a length in the range of 6 to 24 inches pressing on the sanding belt, the pressure on the flexible membrane is in the range of approximately 0.25 to 10 lbs. per square inch and a relative speed between the sanding belt and the panelboard is up to approximately 2,000 feet per minute.

3. The method according to claim 2 wherein the sanding surface of the belt removes a thickness of approximately 0.002 to 0.005 inch evenly from the random contoured surface of the panelboard.

4. The method according to claim 2 wherein the flexible membrane is pressed against the sanding belt at a pressure within the range of 0.5 to 4 lbs. per square inch.

5. The method according to claim 2 wherein the flexible membrane comprises a flexible air bag and a pressure on the sanding surface from the flexible membrane may be varied by varying the pressure of the air in the air bag.

6. The method according to claim 2 wherein the flexible membrane comprises a flexible air bag having a depth in the range of 1 to 4 inches.

7. The method according to claim 2 wherein the pressure on the flexible membrane is applied by a suitable gas, liquid or combination thereof.

8. A method of finishing a longitudinally and transversely random contoured surface of a waferboard initially having a slippery surface with individual wood particles side by side on the surface, comprising the steps of advancing the waferboard in a longitudinal direction in contact with a sanding surface of a sanding belt, pressing a thin flexible membrane, deformable to follow the random contoured surface of the waferboard, with an even pressure onto a portion of the sanding belt to force the sanding surface to follow the random contoured surface of waferboard to remove a thickness of approximately 0.002 to 0.005 inch evenly across the waferboard and leave a finished surface which is non-slippery as compared to the waferboard's original surface.

* * * * *